US008283605B2

(12) United States Patent
Arione et al.

(10) Patent No.: US 8,283,605 B2
(45) Date of Patent: Oct. 9, 2012

(54) PROCESS FOR AUTOMATICALLY CONTROLLING THE HEATING/COOKING OF A FOOD ITEM IN A COOKING OVEN AND COOKING OVEN ADAPTED TO CARRY OUT SUCH PROCESS

(75) Inventors: Ettore Arione, Leggiuno (IT); Alessandro Boer, Cassinetta di Biandronno (IT); Paolo Crosta, Gavirate (IT); Francesco Del Bello, Rome (IT); Davide Parachini, Cassano Magnago (IT); Gianpiero Santacatterina, Sangiano (IT)

(73) Assignee: Whirlpool Corporation, Benton Harbor, MI (US)

( * ) Notice: Subject to any disclaimer, the term of this patent is extended or adjusted under 35 U.S.C. 154(b) by 1034 days.

(21) Appl. No.: 12/128,673

(22) Filed: May 29, 2008

(65) Prior Publication Data

US 2008/0296285 A1 Dec. 4, 2008

(30) Foreign Application Priority Data

May 30, 2007 (EP) ..... 07109162

(51) Int. Cl.
*A21B 1/00* (2006.01)
*A23B 4/03* (2006.01)

(52) U.S. Cl. ..... 219/413; 219/400; 219/490; 219/385; 219/510; 219/518; 700/300; 99/476; 99/478

(58) Field of Classification Search ..... 219/400, 219/413, 385, 490, 510, 518; 99/478, 476; 700/300

See application file for complete search history.

(56) References Cited

U.S. PATENT DOCUMENTS

| | | | | |
|---|---|---|---|---|
| 5,317,133 | A * | 5/1994 | Sundstrom et al. | 219/716 |
| 6,727,476 | B2 | 4/2004 | Kim | |
| 7,554,061 | B2 | 6/2009 | Ruther et al. | |

FOREIGN PATENT DOCUMENTS

| | | |
|---|---|---|
| DE | 19839008 | 3/2000 |
| EP | 1394472 | 3/2004 |

* cited by examiner

*Primary Examiner* — Shawntina Fuqua
(74) *Attorney, Agent, or Firm* — Jason S. Burnette; Diederiks & Whitelaw PLC

(57) ABSTRACT

A method for automatically controlling the heating/cooking of a food item in a cooking oven having a door, heaters and an oven temperature acquisition system, comprising the steps of measuring the total electrical power ($P_{in}$) absorbed by the oven, measuring the oven temperature, and assessing the actual power ($P_{load}$) transferred to the food item by automatically compensating disturbance factors. A cooking oven is also disclosed.

17 Claims, 2 Drawing Sheets

PROCESS FOR AUTOMATICALLY CONTROLLING THE HEATING/COOKING OF A FOOD ITEM IN A COOKING OVEN AND COOKING OVEN ADAPTED TO CARRY OUT SUCH PROCESS

BACKGROUND OF THE INVENTION

1. Field of the Invention

The present invention relates to a method for automatically controlling the heating/cooking of a food item in a cooking oven having a door, heaters and an oven temperature acquisition system.

2. Description of the Related Art

In a traditional oven the user chooses the oven function to be used, together with the set temperature and (optionally) with the cooking time. These parameters (temperature, cooking time and selected function of the oven) are usually unknown to the user and therefore the food cooking is carried out in a not optimal basis, frequently by using empirical rules or on the basis of the experience if the user. Moreover a possible error in inputting the oven temperature or the cooking time can cause an unrecoverable damage to the food.

SUMMARY OF THE INVENTION

A purpose of the present invention is to provide a method for optimising the food preparation/cooking in an oven provided with heaters adapted to heat the cavity thereof.

Another purpose of the present invention is to provide an automatic cooking function able to compensate the influence on cooking performance of different noise factors. Some noise factors that can affect the cooking results are for example: the voltage fluctuation for an electrical oven (that affects directly the power transformed into heat and also the rotation speed of the oven fan), the tolerances/drift of the heating element, the tolerance/drift of closed loop temperature controller (if present), the use of different containers inside the oven and others later described.

Each of the above noise factors influences the cooking performance results when trying to create an automatic cooking function where the oven itself decides automatically the cooking time required.

To compensate the influence of the factors here described the method according to the invention allows an automatic estimate of the "quantity of heat" (in technical words the power) absorbed by the oven. The aim is to control this quantity and to supply to food by food, or to food category by food category, the proper quantity of heating power.

Since the method according to the invention is able to estimate the power to the food, it will be also able to provide the right final energy obtaining the desired cooking result.

The above objects are reached thanks to the features listed in the appended claims.

BRIEF DESCRIPTION OF THE DRAWINGS

Further features and advantages of the present invention will be clear from the following detailed description, with reference to the appended drawings in which.

DETAILED DESCRIPTION OF THE PREFERRED EMBODIMENTS

The present invention is based on a model whose simplified version is shown in the following differential equation (1) in the Laplace domain, that is an example of the relation between the power absorbed by the oven ($P_{in}$) and the power absorbed by the oven load (food):

$$P_{load}(t) = P_{in} \cdot \frac{K_0}{1 + s\tau} + k2 \cdot T'0_{oven} - k3 \cdot T_{ext} \tag{1}$$

where:

$P_{load}$(t)→Power to food;

$P_{in}$→Power absorbed by the entire system oven+food. A power meter installed on the oven measures it;

$T'0_{oven}$→Initial oven temperature measured by the oven probe (and filtered if necessary, by the algorithm). Its precise meaning will be clarified in the following description;

$T_{ext}$→Ambient temperature. In the known traditional ovens it is not measured;

$K_0$, k2, k3→experimental constant values;

s→Laplace operator; and

τ→is a function of the load and of the heat exchange coefficients between heaters towards load and between the oven towards the ambient.

The output of the above model (1) is the power to the food; the algorithm uses this information to evaluate the cooking time, that is the algorithm output. So, the core of the algorithm according to the present invention is the model (1).

With the above model and related control process, an oven according to the invention can compensate different noise factors. Particularly, it is able to compensate for the effect on cooking result of different measured initial oven temperature ($T'0_{oven}$). The applicant has performed two tests in order to show how this compensation has been reached. In the following table 1 the test inputs are reported: different $T'0_{oven}$ values have been used but the same ($P_{in}$,$T_{ext}$) values have been fed in the model (1). Test results are showed as $P_{load}$(t) vs. time in FIG. 1, where τ has a value of 14 sec.

TABLE 1

Figure 1:
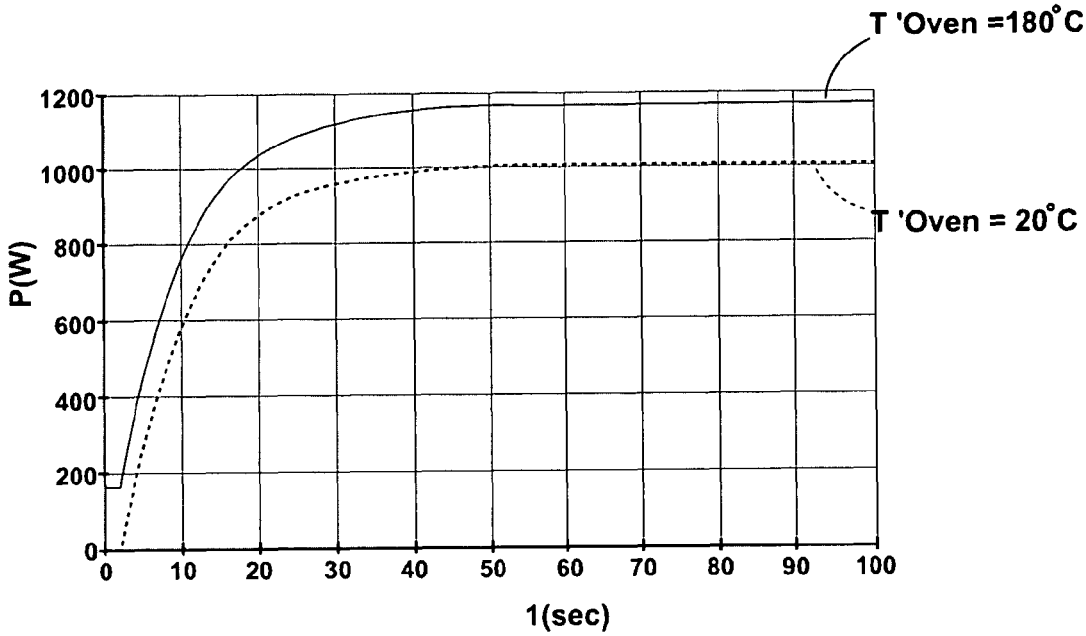
FIG. 1 is a diagram showing the results of power transmitted to the food vs. time by changing the starting temperature of the cavity, in a domestic oven in which the control process according to the invention is implemented.

Conditions used to perform model (1) tests reported in FIG. 1

| $T'0_{oven}$ [°] | $T_{ext}$ [°] | $P_{in}$ (t) [W] |
|---|---|---|
| 180 | 20 | Step: [0→1000] W @ 1 s |
| 20 | 20 | Step: [0→1000] W @ 1 s |

The Initial oven temperature compensation allows the algorithm to achieve high cooking performances, whether the user selects a preheating phase or not.

In analogous way, good results are obtained even if two consecutive baking are carried out, whether the oven cooling between them is performed or not.

Another noise factor that can be compensated according to the present invention is the effect of different containers/tools used on cooking result (dripping-pan, baking-pan, pie-dish, shape or colour). Different container/tools involve different heat absorption, and therefore different $P_{in}$(t) functions. The algorithm according to the present invention, also thanks to the closed loop feedback control system, is able to detect and make up for this kind of variations because it measures the $P_{in}(t)$. The explanation on how different food/container power absorption influences the $P_{in}(t)$ is in the portion of the description referring to the feedback compensation mechanism. According to the model (1), different $P_{in}$ causes different $P_{load}(t)$ Even if all other working conditions do not change, the use of different containers drives different power adsorption by the food, therefore different $P_{in}$. The measure of this latter allows detecting these changes, therefore updating cooking time to the changed conditions.

Another compensation carried out by the algorithm according to the present invention is the compensation of the opening door effect.

A further compensation is related to the different heaters structural tolerances. Different actuators structural tolerances involve different $P_{in}(t)$. The tolerance of the heating element resistivity is typically very high mainly for cost reason. The algorithm according to the present invention, together to temperature control system, is able to make up for the effects on the cooking performance. In this way it is not necessary to use more precise (and expensive) components. Typically the oven temperature control loop is enough to compensate the effect of heaters tolerance when temperature is in steady state, but not during preheating phase or transient phase. In this second case, the algorithm according to the invention, by estimating the power to the food, can compensate the effect of heater tolerance. On the mathematical model (1) the effect of tolerances on $P_{in}$ can be seen thanks to the Ohm law that links power ($P_{in}$) with supplying voltage value ($P_{in}$=V^2/(R+r)), where R is the nominal resistivity value of the heater and r is tolerance thereof). According to model (1), different $P_{in}$ causes different $P_{load}(t)$.

A further compensation is related to heaters performance drift and decay. The heaters suffer performances drift and decay. The algorithm according to the invention is able to offset the effect of drift/decay for the same reasons we exposed in the previous paragraph.

A further compensation is related to the structural tolerances effects of oven temperature acquisition system (oven probe+electronic) and of the performance drift and decay of such system. Since the oven temperature control has to manage a wide range, the oven temperature acquisition system performances are quite poor (+/−5° C.@250° C.) in order to keep low the overall cost of the appliance. This lack of precision causes a big variation of performances from oven to oven. Different close loop temperatures inside the cavity cause different $P_{in}(t)$ and so also different $P_{load}(t)$. As far as the compensation for oven temperature acquisition system (oven probe+electronic) performance drift and decay is concerned, it's not uncommon that food bake makes the temperature probe dirty causing the drift of the performance. The algorithm according to the present invention allows compensating also this kind of drift and decay.

Figure 2:
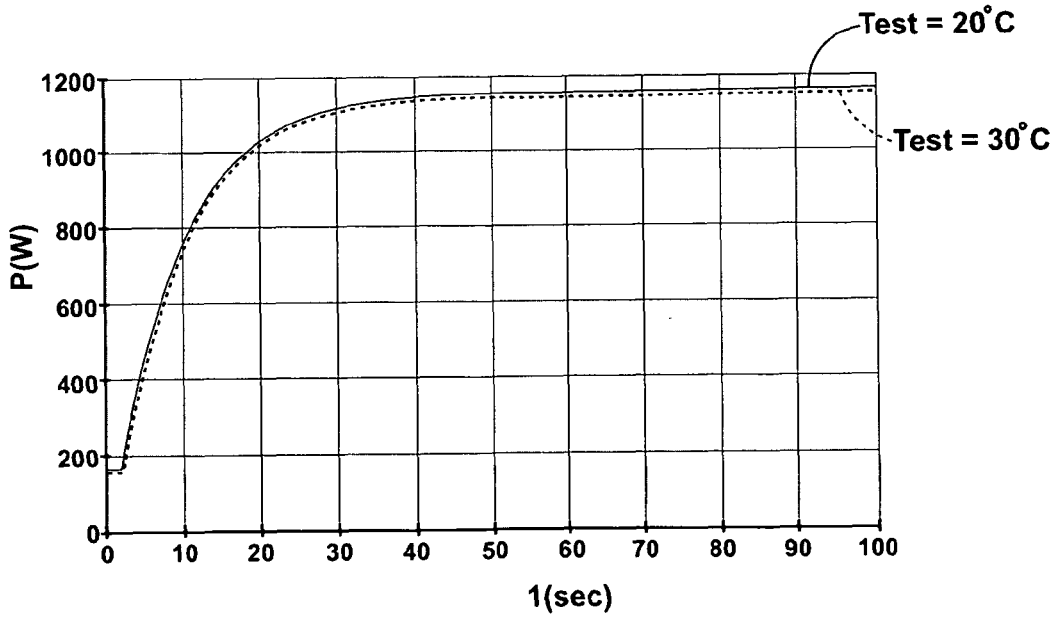
FIG. 2 is a diagram similar to FIG. 1 in which the influence of the ambient temperature is compensated according to the method of the present invention.

A further compensation offsets the ambient temperature variation effects. Feeding up the model (1) by the same $P_{in}(t)$, the applicant made tests summarized in table 2. FIG. 2 shows the two different $P_{load}(t)$ when external temperature ($T_{ext}$) changes. This compensation is similar to the compensation of cavity starting temperature (FIG. 1); also for changes of ambient temperature the applicant with the model (1) carried out tests. With the same profile of $P_{in}$ and of starting temperature of the oven cavity $T0_{oven}$, two tests were carried out for two different values of $T_{ext}$ (table 2). Results are plotted in FIG. 2.

The external temperature $T_{ext}$ can be measured by means of a sensor placed outside the cavity or it can be estimated through the temperature sensor in the cavity of the oven.

TABLE 2

Conditions used to perform model (1) simulations reported in FIG. 2.

| $T'0_{oven}$ [°] | $T_{ext}$ [°] | $P_{in}$ (t) [W] |
|---|---|---|
| 180 | 30 | Step: [0→1000] W @ 1 s |
| 180 | 20 | Step: [0→1000] W @ 1 s |

A further compensation relates to the food insertion delay in case of preheating recipe. Typically, when a preheating phase is required, the oven advises the user when preheating itself is terminated. The user could not react immediately to this information. For this reason the thermodynamic status inside the cavity will be different depending on the delay between the oven notification and user reaction. Different thermodynamic status will cause different $P_{in}(t)$ as explained in the following "feedback compensation mechanism" paragraph.

Figure 3:
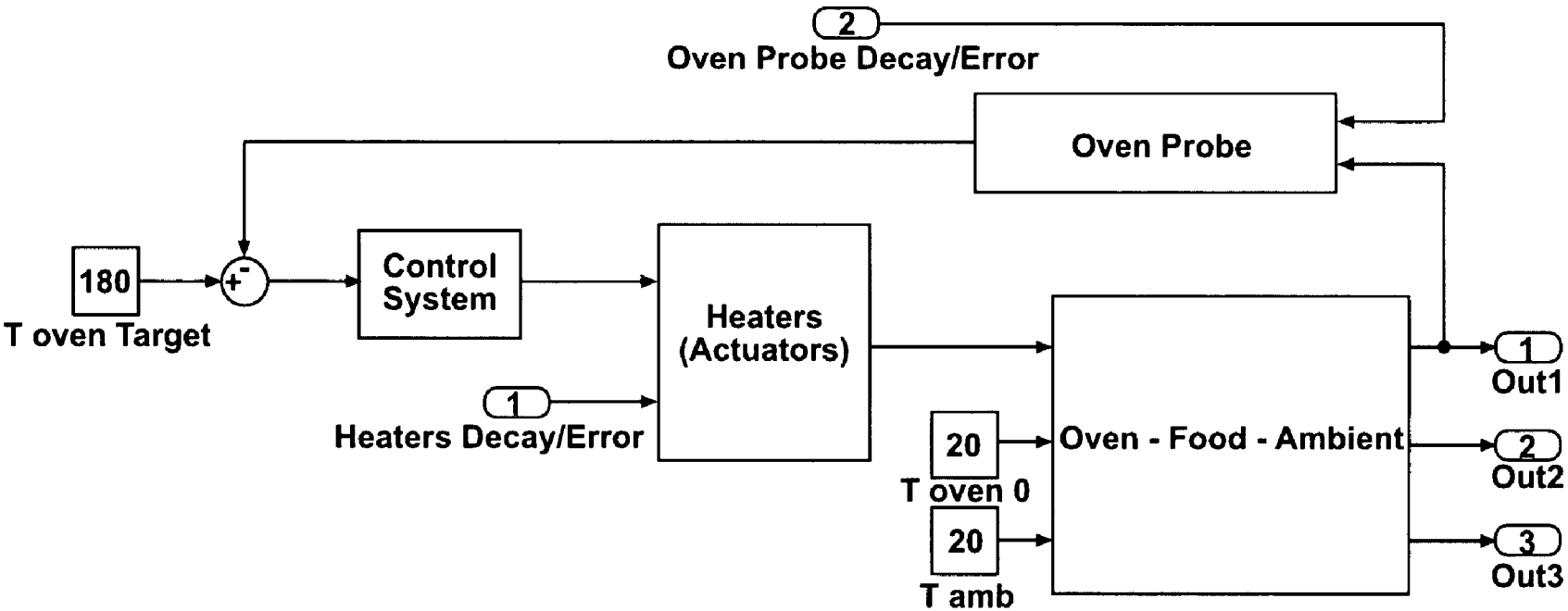
FIG. 3 is a block diagram of the oven/temperature control system according to the present invention.

FIG. 3 shows the block diagram of a temperature feedback (or closed loop) control system. It is composed by the following elements:

- the oven/food/ambient subsystem;
- the heaters model; the heat transferred to the oven depends on the duty cycle imposed by the control system to the actuators, but also on the heater performances drift and decay and structural tolerances;
- the control system. It drives the actuators, establishing the duty cycle of the actuators itself in order to minimise the difference between the oven temperature target (T oven Target) and the measured oven temperature (T' oven);
- oven temperature acquisition subsystem (oven probe+electronic). A temperature sensor provides the temperature of the cavity (T' oven). Read temperature is generally different from the actual temperature due to various contributions (manufacture tolerance, drift, sensor decay).

Closed loop control uses the measure of output parameters of the system to be controlled in order to establish the change of one of input parameters. FIG. 3 reports schematically a typical temperature control used for ovens.

In the following it will be clarifies how the system of FIG. 3 works when there are "noises" (decay/drift/tolerances) on the oven probe and on oven heaters.

Compensation of disturbances acting on the oven temperature acquisition subsystem.

- The control system reacts to any disturbance acting on the oven temperature acquisition subsystem (oven temperature drift/tolerances, electronic drift/tolerances) modifying the duty cycle in order to keep the measured oven temperature (T' oven) equal to the oven target temperature (T oven Target). It's clear that, by modifying the duty cycle of the actuators, also $P_{in}(t)$ is modified. The estimated power transferred to the food $P_{load}(t)$ changes according to model (1). In the new situation the oven adsorbs actually a different $P_{in}$ and, consequently, to food also a different amount of power $P_{load}(t)$ is transferred. But model (1), being based on a $P_{in}$ reading, can keep into account the changed conditions.

Compensation of different colour/material of oven containers/tools.

The temperature control loop acts to keep the temperature inside the cavity equal or closed to target temperature: if the load of the oven changes, the control loop will modify the duty cycle in order to keep the same temperature. Different duty cycle means different Pin.

Compensation of food insertion delay.

If the temperature inside the cavity is different when the food is inserted, also the duty cycle acted by the control system will be different and so also the Pin.

We claim:

1. A method for automatically controlling the heating/cooking of a food item in a cooking oven having a door, heaters and an oven temperature acquisition system, comprising the steps of:

measuring the total electrical power ($P_{in}$) absorbed by the oven;

measuring the oven temperature; and assessing the actual power ($P_{load}$) transferred to the food item by automatically compensating disturbance factors.

2. The method according to claim 1, further comprising the step of measuring the ambient temperature ($T_{ext}$).

3. The method according to claim 2, wherein the disturbance factors are due to at least one of the following items:

initial oven temperature, use of different containers for the food items, heat lost when door is opened, different heater structural tolerances, heater performance drift and/or decay, structural tolerances of the oven temperature acquisition system, drift and/or decay of the oven temperature acquisition system, ambient temperature variation, or food item insertion delay in case of pre-heating recipe.

4. The method according to claim 3, wherein it is based on the following physical model:

$$P_{load}(t) = P_{in} \cdot \frac{K_0}{1 + s\tau} + k2 \cdot T'0_{oven} - k2 \cdot T_{ext}$$

wherein;

$P_{load}(t)$ is the power delivered to food;

$P_{in}$ is the power absorbed by the entire system oven+food and it is measured by a power meter installed on the oven;

$T'0_{oven}$ is the initial oven temperature;

$T_{ext}$ is the ambient temperature;

$K_0$, k2, k3 are experimental constant values;

s is the Laplace operator; and

τ is a function of the load and of the heat exchange coefficients.

5. A cooking oven comprising:

heaters;

an oven temperature acquisition system;

a control unit for automatically controlling the heating/cooking of a food item; and a sensor for detecting the total electrical power ($P_{in}$) absorbed by the oven, wherein the control unit is adapted, on the basis of such total electrical power ($P_{in}$) and of a measure of initial temperature of the oven, to assess the actual power ($P_{load}$) transferred to the food item by automatically compensating disturbance factors.

6. The cooking oven according to claim 5, wherein the disturbance factors are due to at least one of the following items:

initial oven temperature, use of different containers for the food items, heat lost when door is opened, different heater structural tolerances, heater performance drift and/or decay, structural tolerances of the oven temperature acquisition system, drift and/or decay of the oven temperature acquisition system, ambient temperature variation, or food item insertion delay in case of pre-heating recipe.

7. The cooking oven according to claim 6, wherein the control unit works on the basis of the following physical model:

$$P_{load}(t) = P_{in} \cdot \frac{K_0}{1 + s\tau} + k2 \cdot T'0_{oven} - k2 \cdot T_{ext}$$

wherein:

$P_{load}(t)$ is the power delivered to food;

$P_{in}$ is the power absorbed by the entire system oven+food and it is measured by a power meter installed on the oven;

$T'0_{oven}$ is the initial oven temperature;

$T_{ext}$ is the ambient temperature;

$K_0$, k2, k3 are experimental constant value;

s is the Laplace operator; and

τ is a function of the load and of the heat exchange coefficients.

8. The method according to claim 1, further comprising: adjusting a cooking time for the food item based on the actual power ($P_{load}$)transferred to the food item.

9. In a cooking appliance including a door for accessing an oven and heaters for heating the oven, a method for cooking a food item placed in the oven comprising:

measuring an initial temperature within the oven;

measuring a total amount of electrical power absorbed by the oven and the food item;

measuring an ambient temperature about the oven; and calculating an amount of actual power transferred to the food item within the oven based on the initial temperature, the total amount of electrical power absorbed by the oven and the food item, and the ambient temperature.

10. The method according to claim 9, further comprising: adjusting a cooking time for the food item based on the amount of actual power transferred to the food item.

11. The method according to claim 9, further comprising: utilizing a closed loop feedback system to compensate for disturbance factors.

12. The method according to claim 11, wherein the disturbance factors include changes on cooking results based on effects of different cooking containers.

13. The method according to claim 11, wherein the disturbance factors include changes on cooking results based on different heater structural tolerances.

14. The method according to claim 11, wherein the disturbance factors include changes on cooking results based on heater performance drift and decay.

15. The method according to claim 11, wherein the disturbance factors include changes on cooking results based on tolerance effects of an oven temperature acquisition system.

16. The method according to claim 11, wherein the disturbance factors include changes on cooking results based on a delay in insertion of the food item into the oven following preheating of the oven.

17. The method according to claim 9, further comprising:

measuring a temperature within the oven; and modifying a duty cycle of at least one of the heaters to cause the temperature within the oven to equal a target oven temperature.

* * * * *